US008096826B1

(12) United States Patent
Mortun

(10) Patent No.: US 8,096,826 B1
(45) Date of Patent: Jan. 17, 2012

(54) SNAP-ON SWITCH MODULE ASSEMBLY

(75) Inventor: Sorin Ioan Mortun, Irvington, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 13/222,793

(22) Filed: Aug. 31, 2011

Related U.S. Application Data

(60) Continuation of application No. 13/166,157, filed on Jun. 22, 2011, and a division of application No. 12/720,947, filed on Mar. 10, 2010, now Pat. No. 8,021,185.

(51) Int. Cl.
*H01R 13/60* (2006.01)

(52) U.S. Cl. ..... 439/535

(58) Field of Classification Search ..... 439/535, 439/536, 217, 225, 502, 188, 539; 174/53, 174/58
See application file for complete search history.

(56) References Cited

U.S. PATENT DOCUMENTS

| | | | | |
|---|---|---|---|---|
| 4,688,135 | A | 8/1987 | Leopold | |
| 4,794,485 | A | 12/1988 | Bennett | |
| 4,842,551 | A | 6/1989 | Heimann | |
| 4,872,081 | A | 10/1989 | Murphy | |
| 4,883,433 | A | 11/1989 | Lane | |
| 5,434,740 | A | 7/1995 | Chan | |
| 5,455,487 | A | 10/1995 | Mix | |
| 5,598,042 | A | 1/1997 | Mix | |
| 5,844,763 | A | 12/1998 | Grace | |
| 6,678,140 | B2 | 1/2004 | Jakwani | |
| 6,692,270 | B2 | 2/2004 | Bencivenga et al. | |
| 6,755,676 | B2 | 6/2004 | Milan | |
| 6,994,585 | B2 | 2/2006 | Benoit | |
| 7,189,110 | B1 | 3/2007 | Savicki | |
| 7,195,517 | B1 | 3/2007 | Savicki | |
| 7,285,009 | B1 | 10/2007 | Benoit | |
| 7,323,638 | B1 | 1/2008 | Radosavljevi | |
| 7,361,051 | B2 | 4/2008 | Gorman | |
| 7,407,410 | B1 | 8/2008 | Benoit | |
| 7,497,725 | B2 | 3/2009 | Savicki | |
| 7,510,429 | B1 | 3/2009 | Savicki | |
| 7,575,470 | B2 | 8/2009 | Pyrros | |
| 7,628,643 | B2 | 12/2009 | Pyrros | |
| 7,666,010 | B2 | 2/2010 | Arenas | |
| 7,736,174 | B2 | 6/2010 | Bhosale | |
| 7,780,470 | B2 | 8/2010 | Benoit | |
| 7,790,982 | B2 | 9/2010 | Weeks | |
| 7,824,196 | B1 | 11/2010 | Oddsen | |
| 8,021,185 | B1 * | 9/2011 | Mortun | 439/535 |
| 2007/0259548 | A1 | 11/2007 | Byrne | |
| 2010/0277306 | A1 | 11/2010 | Leinen | |
| 2011/0012433 | A1 | 1/2011 | Parsons | |
| 2011/0156911 | A1 | 6/2011 | Caglianone | |

* cited by examiner

*Primary Examiner* — Jean F Duverne
(74) *Attorney, Agent, or Firm* — Marcus R. Mickeny; Mark S. Bicks

(57) ABSTRACT

A snap-on switch module assembly includes a plug connector adapted to be received by an electrical device. A second housing is connected to a first housing. A switch device is disposed between the first and second housings. At least one first opening is formed in the second housing. A plurality of wires pass through the at least one first opening and are connected to the switch device. Accordingly, the switch device protects and controls electrical apparatus connected to the electrical device.

20 Claims, 9 Drawing Sheets

SNAP-ON SWITCH MODULE ASSEMBLY

CROSS REFERENCE TO RELATED APPLICATION

This application is a continuation of U.S. patent application Ser. No. 13/166,157, filed Jun. 22, 2011, which is a division of U.S. patent application Ser. No. 12/720,947, filed Mar. 3, 2010, the entire disclosures of both of which are hereby incorporated by reference.

FIELD OF THE INVENTION

The present invention relates to a switch assembly for controlling the supply of electrical power to an electrical device. More particularly, the present invention relates to a surge snap-on module assembly for an electrical device. Still more particularly, the present invention relates to a surge snap-on module assembly having an integral connector to provide surge protection for an electrical receptacle.

BACKGROUND OF THE INVENTION

An electrical apparatus is subject to surges of current over the power lines to which the electrical apparatus is connected. These current surges can be caused by naturally occurring phenomenon, such as lightning strikes, or by man-made causes, such as variations in the power being output from a generating station, both of which induce power surges in the power lines. Subjecting the electrical apparatus to these power surges can result in damage to or destruction of the electrical apparatus. Accordingly, the electrical apparatus needs to be protected from these power surges.

Surge protection is typically not provided by the electrical wiring device, such as an electrical receptacle, to which the electrical apparatus is connected. A surge protection power strip is often used to protect the electrical apparatus from a power surge. The surge protection power strip is generally plugged into the electrical receptacle, and the electrical apparatus to be protected is plugged into the surge protection power strip. The surge protection power strip requires the user to obtain the surge protection power strip before being able to protect the electrical apparatus from electrical surges. Additionally, the surge protection power strip provides an unsightly means for protecting the electrical apparatus from electrical surges, as well as taking up extra space for the surge protection power strip. Accordingly, a need exists for protecting an electrical apparatus from electrical surges without requiring a surge protection power strip.

Some electrical receptacles have apertures in their rear faces for receiving a plug terminating a plurality of wires, as disclosed in U.S. Pat. No. 4,842,551 to Heimann. The wires terminated by the plug are connected to the existing wires in any suitable manner, such as by a clamp receptacle or a wire nut. Thus, an electrician is not required to connect the plug to the receptacle. However, those electrical receptacles do not provide surge protection to any electrical apparatus connected to the electrical receptacle for power. Accordingly, a need exists for a surge snap-on module assembly that connects to the electrical receptacle to provide surge protection to an electrical apparatus connected to the electrical receptacle for power.

SUMMARY OF THE INVENTION

Accordingly, it is a primary objective of the present invention to provide an electrical device that protects or controls electrical apparatuses connected thereto from electrical surges.

A further objective of the present invention is to provide a control snap-on module assembly that controls electrical power to an electrical wiring device to protect or control electrical components connected thereto.

Another objective of the present invention is to provide a control snap-on module assembly having an integrally formed plug connector.

The foregoing objectives are basically attained by a plug connector adapted to be received by an electrical wiring device. A second housing is connected to a first housing. A switch device is disposed between the first and second housings. At least one first opening is formed in the second housing. A plurality of wires pass through the at least one first opening and are connected to the switch device. Accordingly, the switch device protects and controls electrical apparatus connected to the electrical wiring device, such as protection from electrical surges.

The foregoing objectives are also basically attained by a method of providing control for an electrical receptacle. A first plurality of electrical wires of a control snap-on module assembly are connected to a second plurality of electrical wires of a power source. A plug connector of the control snap-on module assembly is connected to the electrical receptacle, thereby controlling electrical power to the electrical receptacle to protect or control electrical components connected thereto.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the high-voltage test terminal, and are not intended to limit the structure of the high voltage test terminal to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
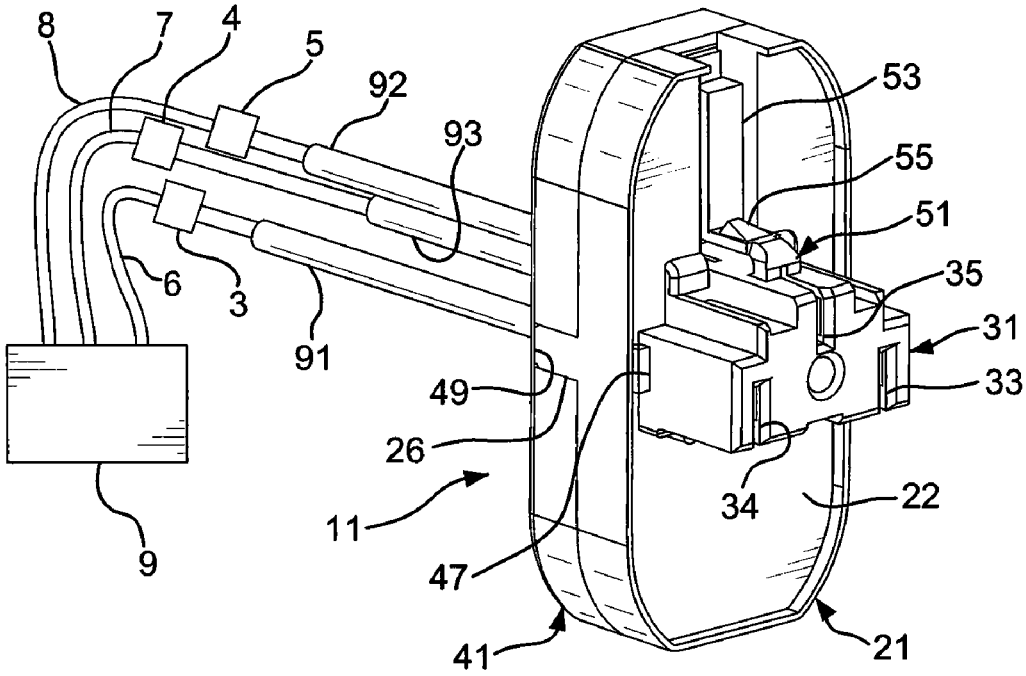
FIG. 1 is a front perspective view of a snap-on module assembly according to an exemplary embodiment of the present invention.

As shown in FIGS. 1-17, a snap-on module assembly 11 includes a first housing 21, a second housing 41 connected to the first housing, an electrically operated switch in the form of a surge protection device 61 disposed between and enclosed within the first and second housings and a plug connector 31 connected to the first housing. The plug connector 31 is adapted to be received by an electrical wiring device, such as the electrical receptacle 10 shown in FIGS. 9 and 10. The surge snap-on module assembly 11 is connected to a snap-on type electrical receptacle 10, or any other snap-on type electrical wiring device, to allow the electrical wiring device to control the supply of electrical power thereto, particularly with surge protection. Accordingly, an electrical apparatus (not shown) connected to the electrical receptacle 10 to receive power therefrom is controlled and protected from electrical surges.

The surge snap-on module assembly 11 is described with a plug connector 31 having three wires 91, 92 and 93 connected thereto, as shown in FIGS. 1-3, 5, 9, 10 and 17, although the snap-on module assembly of the present invention is not so limited. Any suitable number of wires may be used as required by the electrical device with which the snap-on module assembly is used. These three wires are connectable to the building wiring extending into a standard electrical box mounting electrical receptacle 10.

Figure 3:
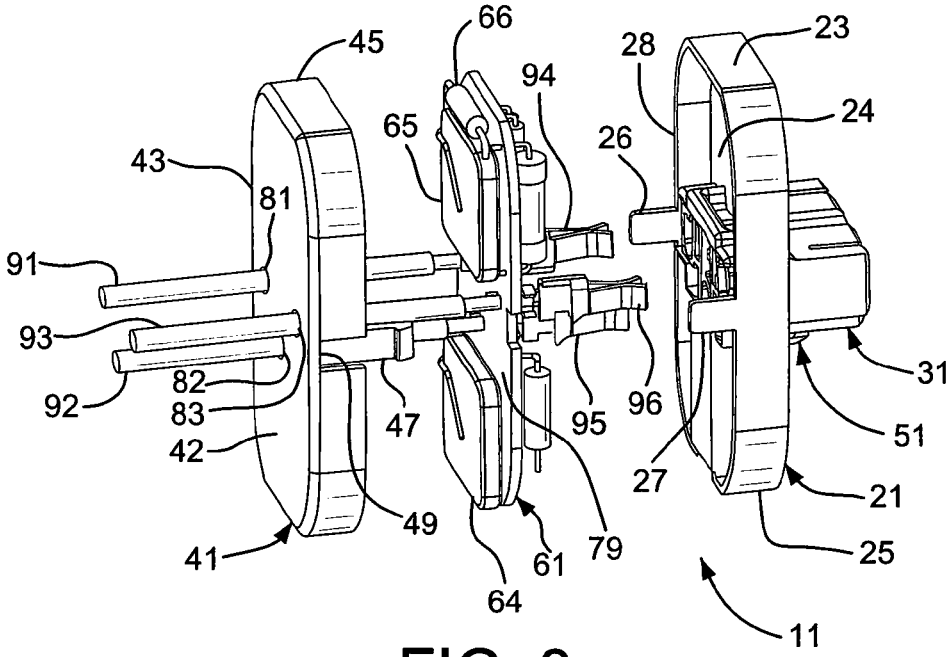
FIG. 3 is an exploded perspective view of an unassembled snap-on module assembly of FIG. 1.
Figure 4:
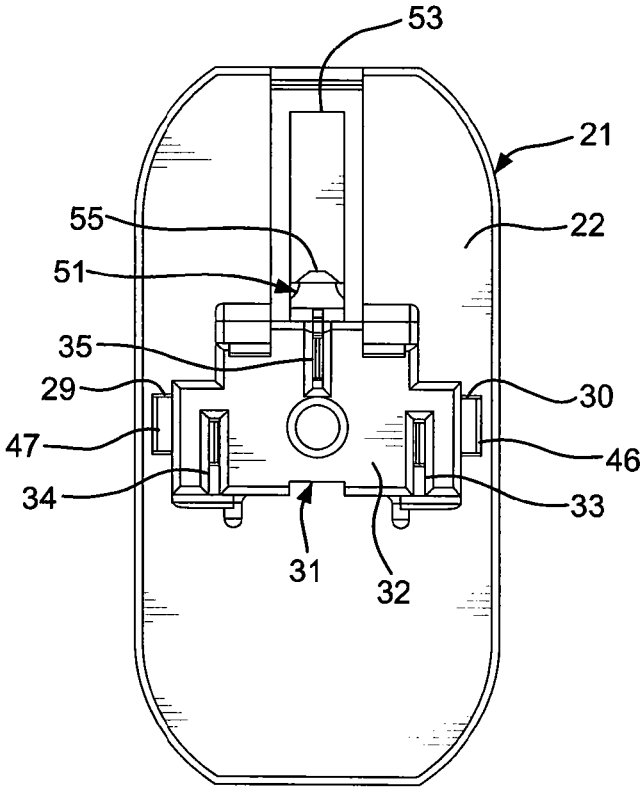
FIG. 4 is a front elevational view of the snap-on module assembly of FIG. 1.
Figure 5:
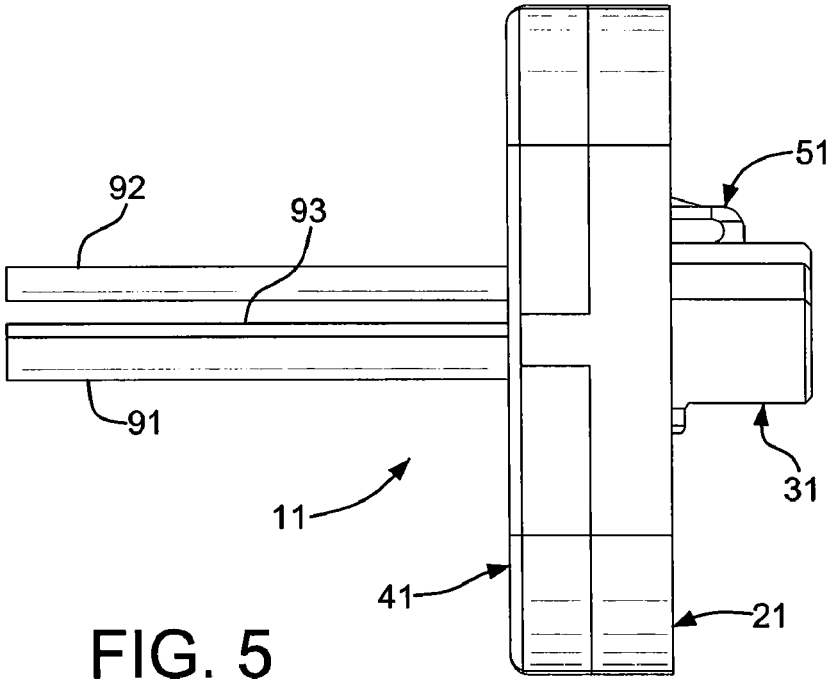
FIG. 5 is a side elevational view of the snap-on module assembly of FIG. 1.
Figure 6:
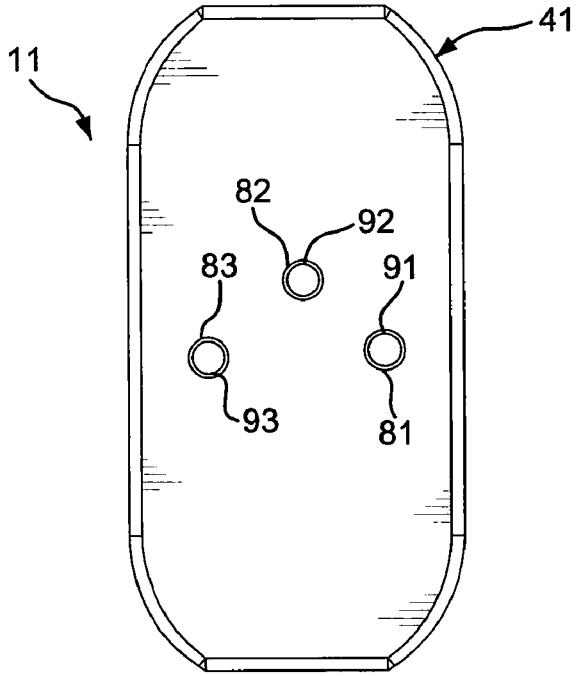
FIG. 6 is a rear elevational view of the snap-on module assembly of FIG. 1.
Figure 11:
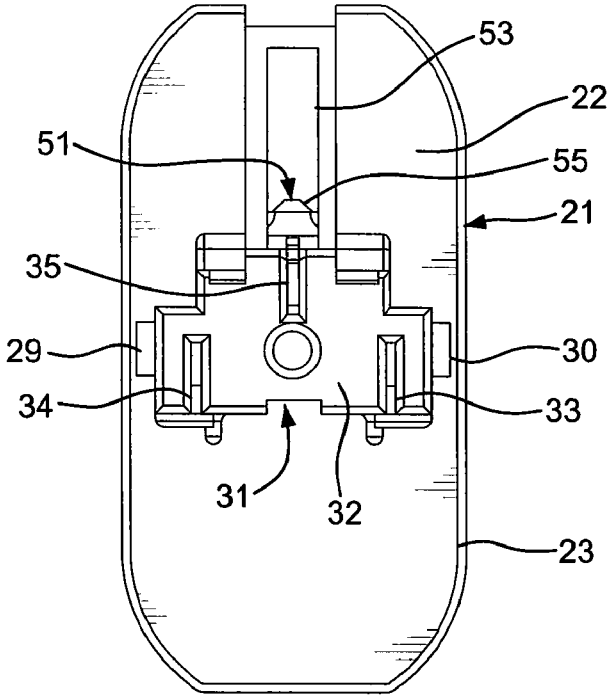
FIG. 11 is a front elevational view of the front housing of the snap-on module assembly with a plug connector disposed therein.

The first housing 21, as shown in FIGS. 3, 4, 11 and 12, has a base 23 having an outer surface 22 and an inner surface 24. A wall 25 extends preferably substantially perpendicularly to the base 23. First and second tabs 26 and 27 extend outwardly from a free end 28 of the wall 25. Preferably, the first and second tabs 26 and 27 are substantially perpendicular to the base 23. First and second openings 29 and 30 are formed in the base, as shown in FIGS. 4 and 11.

Figure 12:
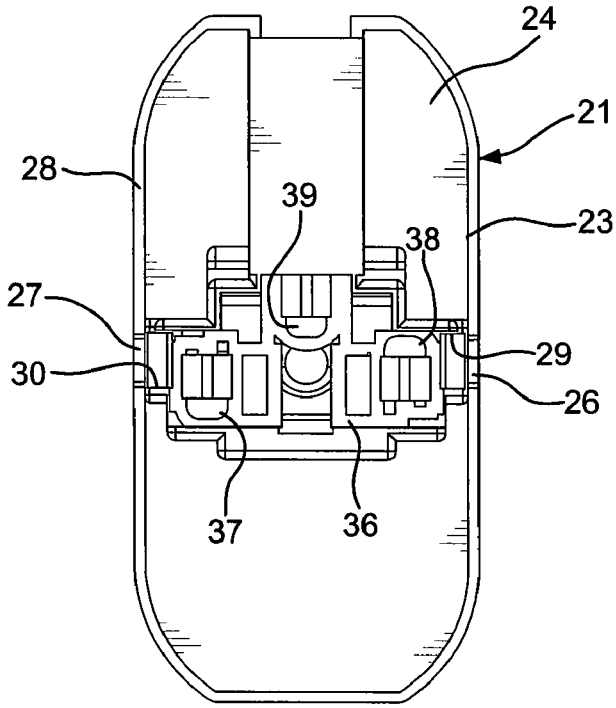
FIG. 12 is a rear elevational view of the front housing of FIG. 11.
Figure 13:
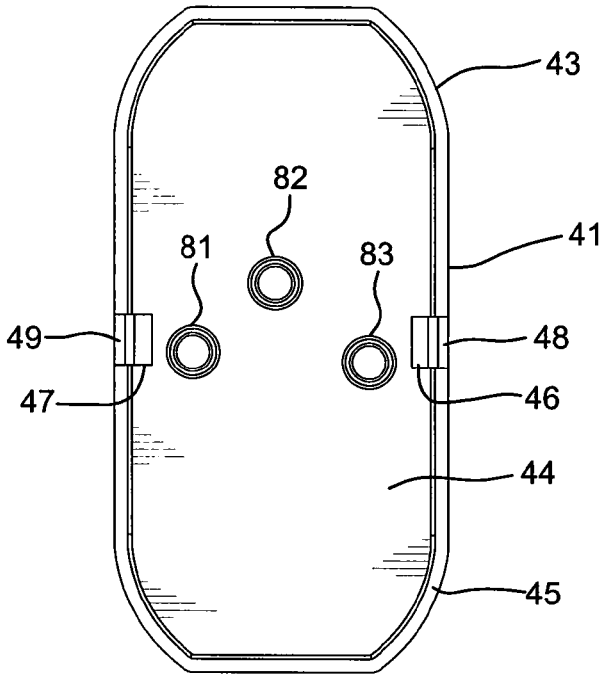
FIG. 13 is front elevational view of the rear housing of the snap-on module assembly.
Figure 14:
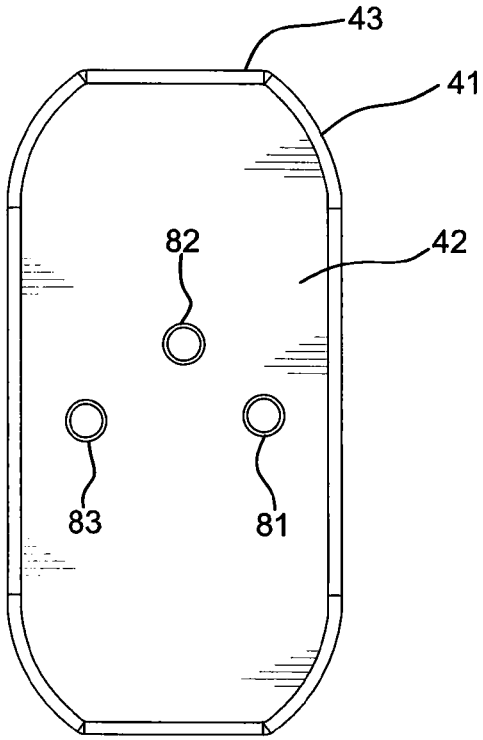
FIG. 14 is a rear elevational view of the rear housing of FIG. 13.
Figure 15:
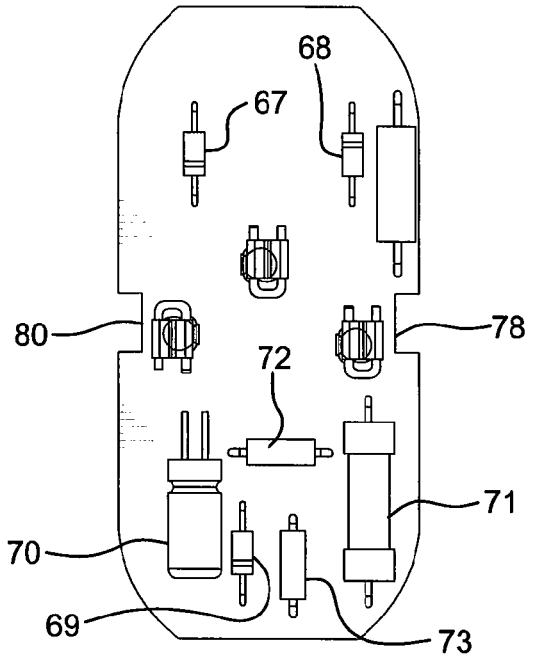
FIG. 15 is a front elevational view of the protection device of the snap-on module assembly.
Figure 16:
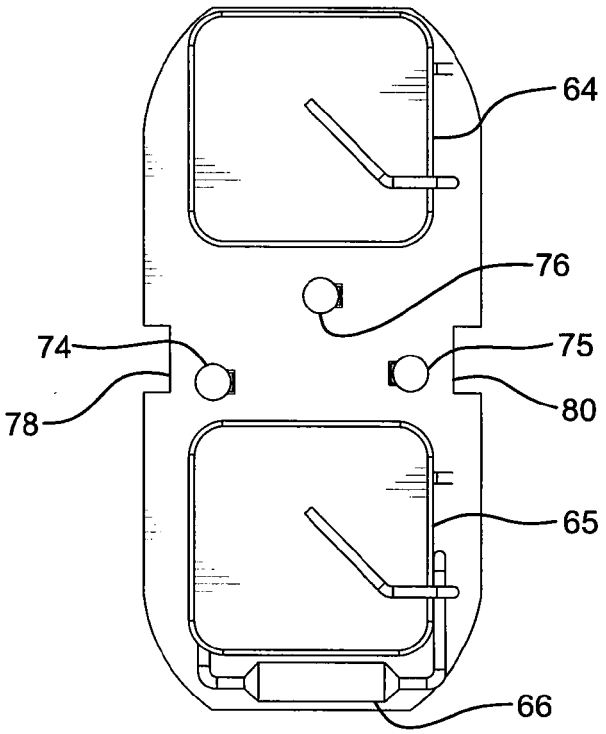
FIG. 16 is a rear elevational view of the protection device of FIG. 15.

The plug connector 31, as shown in FIGS. 3, 4, 11 and 12, is connected to the first housing 21. Preferably, the plug connector 31 is unitarily formed with the first housing 21 as a one-piece member. A plurality of openings 33, 34 and 35 are disposed in a front face 32 of the plug connector 31, as shown in FIG. 11. A plurality of openings 37, 38 and 39 are formed in a rear face 36 of the plug connector 31, as shown in FIG. 12. A passageway is formed between each pair of corresponding openings, i.e., a passageway 50 between openings 33 and 37, a passageway between openings 34 and 38, and a passageway 40 between openings 35 and 39.

Figure 7:
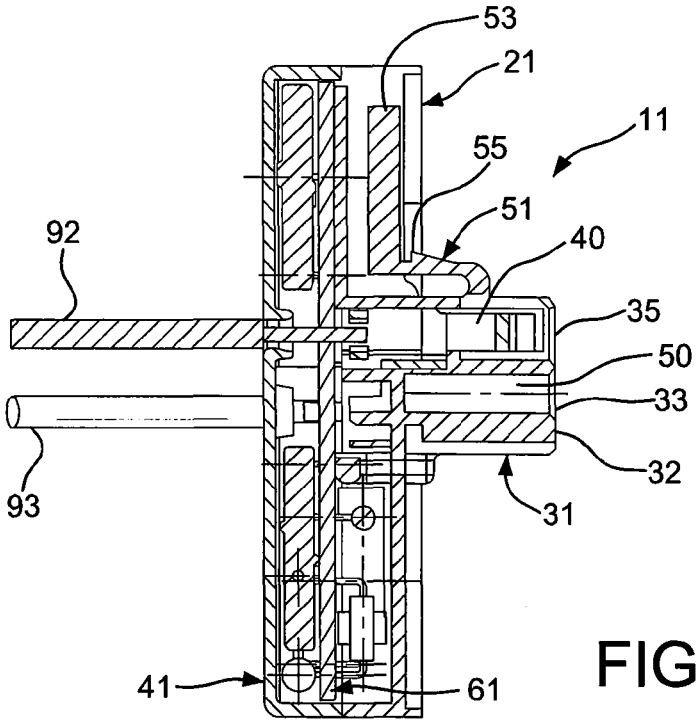
FIG. 7 is a side elevational view in cross section of the snap-on module assembly of FIG. 4.
Figure 8:
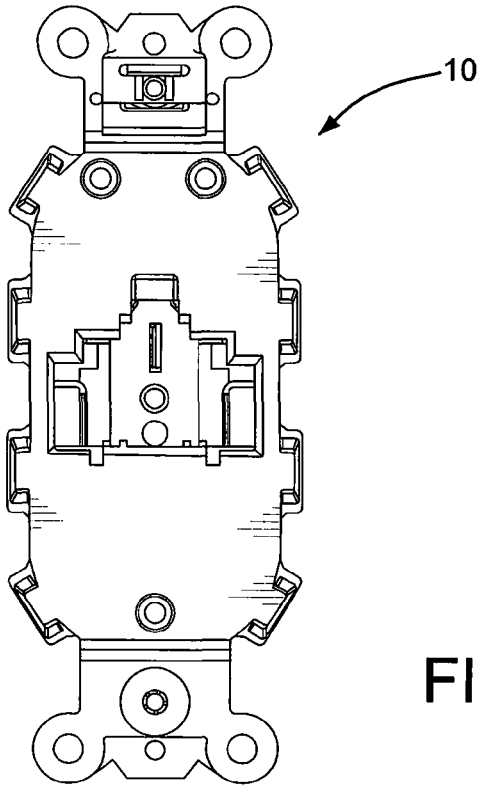
FIG. 8 is a rear elevational view of an electrical receptacle.

A latch beam 51 extends rearwardly from an upper surface of the plug connector 31, as shown in FIGS. 1 and 7. The latch beam 51 is flexible to facilitate connecting to and disengaging from the electrical receptacle 10. The latch beam 51 is deflectable to disengage the surge snap-on module assembly 11 from a mated connection with the electrical receptacle 10. A latch beam deflecting member 53 extends upwardly from a rearward end of the latch beam 51. Preferably, the deflecting member 53 extends substantially parallel to the outer surface 22 of the first housing 21. Pushing downwardly on the deflecting member 53 allows the plug connector 31 to be disconnected from the electrical receptacle 10. A latch 55 extends upwardly from a forward end of the latch beam 51 and engages an overhang 13 (FIG. 9) of the electrical receptacle 10 to secure the plug connector 31 to the electrical receptacle. The latch 55 prevents the plug connector 31 from being withdrawn from the electrical receptacle until the deflecting member 53 is deflected downwardly such that the latch 55 is no longer engaging the overhang 13, thereby allowing the plug connector to be withdrawn.

The second housing 41, as shown in FIGS. 3, 4, 13 and 14, has a base 43 having an outer surface 42 and an inner surface 44. A wall 45 extends outwardly from an inner surface 44 of the second housing 41. Preferably, the wall 45 extends substantially perpendicularly to the base 43. First and second flexible arms 46 and 47 extend outwardly or forwardly from the inner surface 44 of the base 43. Preferably, the first and second flexible arms 46 and 47 are substantially perpendicular to the base 43 and extend beyond the wall 45. First and second slots 48 and 49 are formed in the wall 45, as shown in FIG. 3. A plurality of openings 81, 82 and 83 are formed in the second housing 41 to receive the plurality of wires 91, 92 and 93.

Figure 17:
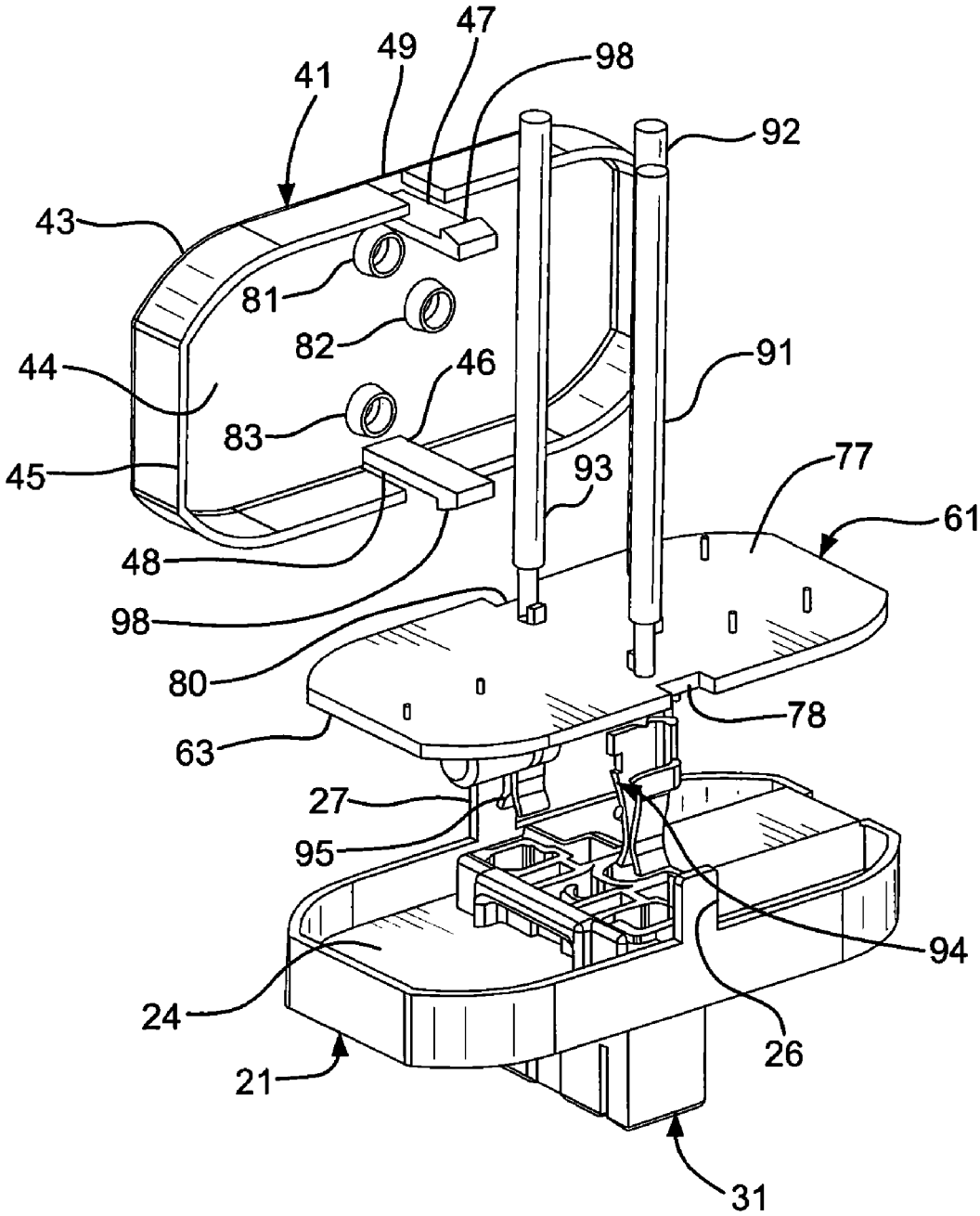
FIG. 17 is an exploded perspective view of a partially assembled snap-on module assembly of FIG. 1.

The surge protection device 61, as shown in FIGS. 3 and 15-17, is preferably a conventional surge protection device. A printed circuit board 63 is substantially planar and has a first surface 77 and a second surface 79. The first surface 77 faces the inner surface 24 of the first housing 21. The second surface 79 faces the inner surface 44 of the second housing 41. Recesses 78 and 80 are formed in the printed circuit board 63, as shown in FIG. 17. A plurality of electrical components typically associated with conventional surge protection devices are connected to the first and second surfaces 77 and 79 of the printed circuit board 63. These electrical components may include, but are not limited to, metal oxide varistors 64 and 65, a thermal cutoff 66, diodes 67, 68 and 69, a capacitor 70, a fuse 71, and resistors 72 and 73. Openings 74, 75 and 76 are formed in the board 63 to receive the wires 91, 92 and 93 and the electrical contacts 94, 95 and 96, which terminate the wires.

Assembly and Operation

Figure 2:
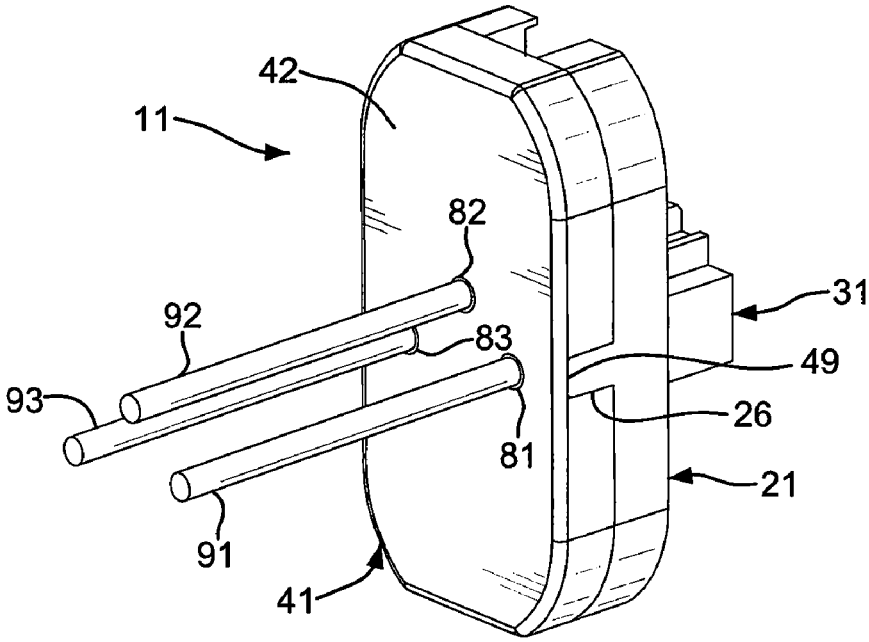
FIG. 2 is a rear perspective view of the snap-on module assembly of FIG. 1.

The surge snap-on module assembly 11 is shown completely assembled in FIGS. 1 and 2, and disassembled in FIGS. 3 and 17. The plug connector 31 is connected to the first housing 21 in any suitable manner. In a preferred embodiment, the plug connector 31 is integrally formed with the first housing 21 as a one-piece member.

Wires 91, 92 and 93 are passed through openings 74, 75 and 76 in the printed circuit board 63 of the surge protection device 61, as shown in FIGS. 3 and 17. Insulation is removed from the end of the wires as required to facilitate passing the wires through the openings in the circuit board and terminating the wires with electrical contacts 94, 95 and 96. Preferably, the wires are crimped to the electrical contacts. Tabs of the electrical contacts and the wires create a press fit in the openings 74, 75 and 76 of the circuit board 63. Preferably, the wires and the electrical contacts are then soldered to the circuit board. The electrical contacts 94, 95 and 96 are then inserted in the openings 37, 38 and 39 in the rear face 36 of the plug connector 31. Barbs on the electrical contacts create a press fit with the plug connector 31, thereby securely retaining the electrical contacts within the plug connector. The non-terminated ends of the wires 91, 92 and 93 are then passed through openings 81, 82 and 83 in the second housing 41, as shown in FIG. 3.

The first and second housings are then connected together, thereby disposing the entirety of the surge protection device 61 between the first and second housings, as shown in FIG. 7. The first and second tabs 26 and 27 of the first housing 21 engage the hooks 97 and 98 of the first and second flexible arms 46 and 47 of the second housing 41, thereby moving the flexible arms inwardly toward one another. The recesses 78 and 80 in the circuit board 63 allow the flexible arms 46 and 47 to pass therethrough. The flexible arms 46 and 47 then pass through the openings 29 and 30 in the first housing 21. The hooks 97 and 98 snap back to their original position and engage the outer surface 22 of the first housing 21, as shown in FIG. 1, thereby locking the first and second housings together and preventing separation of the surge snap-on module assembly 11. The non-terminated ends of the wires 91, 92 and 93 may then be terminated to existing wires 6, 7 and 8 connected to a power distribution center 9 by wire nuts 3, 4 and 5, such that electrical power may be transmitted by the surge snap-on module assembly 11, as shown in FIG. 1.

Figure 9:
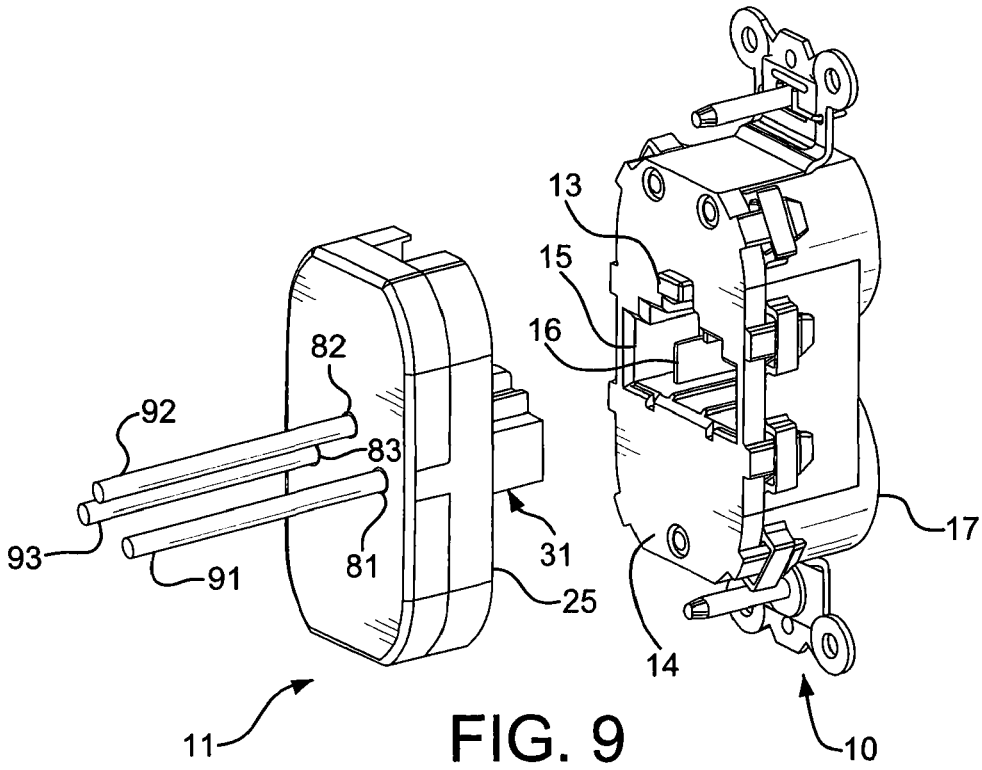
FIG. 9 is a perspective view of the snap-on module assembly of FIG. 1 prior to being connected to the electrical receptacle of FIG. 8.
Figure 10:
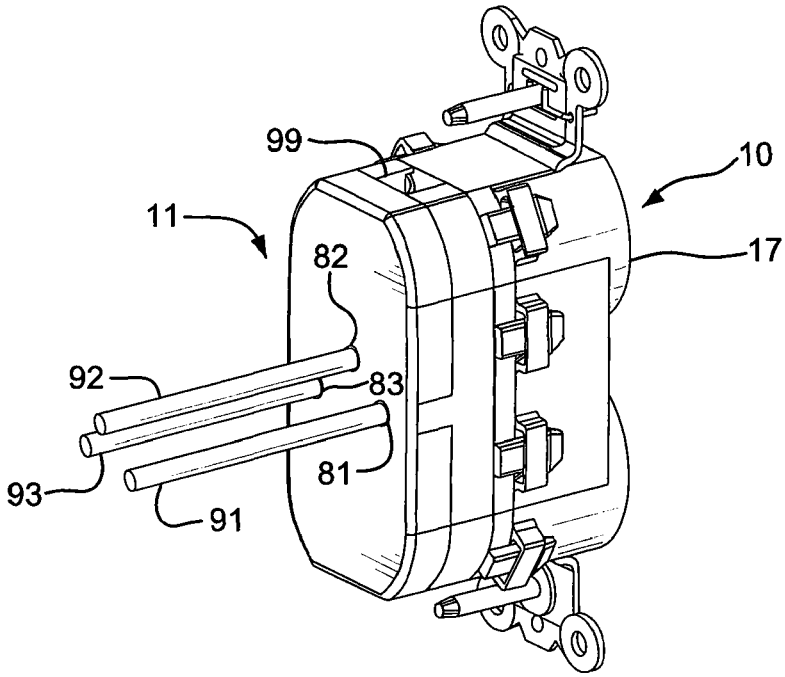
FIG. 10 is a perspective view of the snap-on module assembly of FIG. 1 connected to the electrical receptacle of FIG. 8.

The assembled surge snap-on module assembly 11 is then ready to be connected to an electrical receptacle 10, as shown in FIGS. 9 and 10. The electrical receptacle 10 has a rear face 14 having an aperture 15 therein adapted to receive the plug connector 31 of the surge snap-on module assembly 11. Electrical blades 16 are disposed within the aperture 15. Each electrical contact 94, 95 and 96 of the plug connector 31 has a corresponding blade within the aperture 15. Accordingly, for the plug connector 31 having three electrical contacts, there are three blades in the aperture 15 of the electrical receptacle. The plug connector 31 is inserted in the aperture 15, such that each electrical contact 94, 95 and 96 engages a blade 16, until the wall 25 engages the rear surface 14 of the electrical receptacle, as shown in FIG. 10. The overhang 13 engages the latch 55 of the latch beam 51, thereby deflecting the latch beam 51 downwardly. Once the latch 55 passes behind the overhang 13, the plug connector 31 is securely retained within the aperture 15 of the electrical receptacle 10. The latch 55 prevents withdrawal of the plug connector 31 from the aperture 15 by abutting the overhang 13. Depressing the deflecting member 53, which is accessible through the opening 99 in the surge snap-on module assembly 11, as shown in FIG. 10, deflects the latch 55 downwardly, such that the overhang 13 does not prevent the plug connector 31 from being withdrawn. A tool, such as a screwdriver, may be used to access the deflecting member 53 in the opening 99.

When the plug connector 31 is connected to the blades 16 of the electrical receptacle 10, electrical power is transmitted through the surge snap-on module assembly to an electrical apparatus connected to a front face 17 of the electrical receptacle 10. In this manner, assembly 11 connects receptacle 10 to the building wiring as well as providing surge protection. The surge device 61 prevents damage to the electrical apparatus connected to the electrical receptacle 10 from electrical surges in an easy and efficient manner. Additionally, an additional surge protection device, such as a surge protection power strip, is not required to be connected to the front face 17 of the electrical receptacle 10.

While an advantageous embodiment has been chosen to illustrate the invention, it will be understood by those skilled in the art that various changes and modifications may be made therein without departing from the scope of the invention as defined in the appended claims.

What is claimed is:

1. An electrical module assembly, comprising:

a housing assembly;

a plug connector connectable to an electrical device and fixedly connected to said housing assembly;

an electrically operated switch disposed within said housing assembly;

at least one first opening formed in housing assembly; and a plurality of wires passing through said at least one first opening and connected to said electrically operated switch without being connected through said plug connector.

2. The electrical module assembly of claim 1, wherein said plug connector is unitarily formed with said housing assembly as a one-piece member.

3. The electrical module assembly of claim 1, wherein each of said at least one first openings receives one of said plurality of wires.

4. The electrical module assembly of claim 1, wherein said housing assembly includes a first housing connected to a second housing, said plug connector being fixedly connected to said first housing and said at least one opening being formed in said second housing.

5. The electrical module assembly of claim 4, wherein a pair of flexible fingers extend outwardly from said second housing to facilitate connecting said second housing to said first housing.

6. The electrical module assembly of claim 5, wherein a pair of second openings formed in said first housing to receive said pair of flexible fingers.

7. The electrical module assembly of claim 1, wherein a latch beam connected to said plug connector releasably connects said plug connector to the electrical device.

8. The electrical module assembly of claim 7, wherein a deflecting member connected to said latch beam and accessible from outside said housing assembly is movable to deflect said latch beam to release said plug connector from the electrical device.

9. The electrical module assembly of claim 1, wherein said electrically operated switch includes a circuit board.

10. The electrical module assembly of claim 9, wherein a plurality of contact terminals are connected to said circuit board and terminate said plurality of wires.

11. The electrical module assembly of claim 10, wherein said plurality of contact terminals are received by said plug connector.

12. An electrical module assembly, comprising:

a housing assembly;

a plug connector connectable to an electrical device and fixedly connected to said housing assembly;

means for electrically controlling power to the electrical device, said means for electrically controlling power to the electrical device being disposed within said housing assembly;

at least one first opening formed in housing assembly; and a plurality of wires passing through said at least one first opening and connected to said means for electrically controlling power to the electrical device without being connected through said plug connector.

13. The electrical module assembly of claim 12, wherein said plug connector is unitarily formed with said housing assembly as a one-piece member.

14. The electrical module assembly of claim 12, wherein each of said at least one first openings receives one of said plurality of wires.

15. The electrical module assembly of claim 12, wherein said housing assembly includes a first housing connected to a second housing, said plug connector being fixedly connected to said first housing and said at least one opening being formed in said second housing.

16. The electrical module assembly of claim 12, wherein a latch beam connected to said plug connector releasably connects said plug connector to the electrical device.

17. The electrical module assembly of claim 16, wherein a deflecting member connected to said latch beam and accessible from outside said housing assembly is movable to deflect said latch beam to release said plug connector from the electrical device.

18. The electrical module assembly of claim 12, wherein said means for controlling power to the electrical device includes a circuit board.

19. The electrical module assembly of claim 18, wherein a plurality of contact terminals are connected to said circuit board and terminate said plurality of wires.

20. The electrical module assembly of claim 19, wherein said plurality of contact terminals are received by said plug connector.

* * * * *